US006098580A

United States Patent [19]

Goto et al.

[11] Patent Number: 6,098,580

[45] Date of Patent: Aug. 8, 2000

[54] VARIABLE VALVE ACTUATOR APPARATUS

[75] Inventors: Tetsuro Goto; Yoshihiko Yamada, both of Kanagawa, Japan

[73] Assignees: Nissan Motor Co., Ltd.; Unisia Jecs Corporation, both of Kanagawa, Japan

[21] Appl. No.: 09/145,224

[22] Filed: Sep. 1, 1998

[30] Foreign Application Priority Data

Sep. 2, 1997 [JP] Japan ..... 9-236624

[51] Int. Cl.[7] ..... F01L 13/00

[52] U.S. Cl. ..... 123/90.17; 123/90.27; 123/90.31; 123/193.3

[58] Field of Search ..... 123/90.15, 90.16, 123/90.17, 90.27, 90.31, 90.6, 193.5, 193.3; 74/568 R

[56] References Cited

U.S. PATENT DOCUMENTS

| | | | |
|---|---|---|---|
| 5,333,579 | 8/1994 | Hara et al. | 123/90.17 |
| 5,365,896 | 11/1994 | Hara et al. | 123/90.17 |
| 5,501,186 | 3/1996 | Hara et al. | 123/90.17 |
| 5,557,983 | 9/1996 | Hara et al. | 74/568 R |
| 5,645,020 | 7/1997 | Yamada | 123/90.17 |
| 5,687,681 | 11/1997 | Hara | 123/90.17 |
| 5,778,840 | 7/1998 | Murata et al. | 123/90.17 |
| 5,787,849 | 8/1998 | Mitchell | 123/90.17 |

FOREIGN PATENT DOCUMENTS 7-119425 5/1995 Japan .

*Primary Examiner*—Weilun Lo
*Attorney, Agent, or Firm*—McDermott, Will & Emery

[57] ABSTRACT

A VVA apparatus includes a control rod controlling position of each of supports that are held for movement within a plane perpendicular to a shaft axis of a driving shaft. The supports have intermediate members, each being drivingly connected between a driving sleeve and a driven hollow camshaft. Spaced cam brackets hold the hollow cams, respectively, on a cylinder head of an engine. The control rod has eccentric cams at predetermined spaced portions for driving connection with the supports, respectively. A control rod holding structure includes a base portion fixed to the cylinder head and bearing portions extending from the base portion. The bearing portions of the control rod holding structure hold the control rod at locations in the vicinity of the predetermined spaced portions where the eccentric cams are.

10 Claims, 6 Drawing Sheets

VARIABLE VALVE ACTUATOR APPARATUS

FIELD OF THE INVENTION

The present invention relates to a variable valve actuator (VVA) apparatus for an internal combustion engine, and more particularly to a VVA apparatus that enables a cam controlling an engine cylinder valve to be moved relative to its driving shaft.

BACKGROUND OF THE INVENTION

U.S. Pat. No. 5,333,579 issued Aug. 2, 1994 and U.S. Pat. No. 5,557,983 issued Sept. 24, 1996 disclose a VVA apparatus of the above kind. This known apparatus comprises a driving shaft having a shaft axis of rotation, a driving member fixed to the driving shaft for rotation about the shaft axis, a driven member movable relative to the driving shaft for rotation about the shaft axis. The driven member has an integral cam controlling an engine cylinder valve. An intermediate member is drivingly connected between the driving and driven members. A support has mounted therein the intermediate member mounted for rotation so as to rotate concentrically or eccentrically with respect to the shaft axis. The support is held for movement within a plane perpendicular to the shaft axis. A control rod has an integral eccentric cam received in a radial slot cut inwardly into the support. The support is also formed with a second opening that receives a pivot shaft fixed relative to the engine cylinder head. Rotating the control rod from one angular position to another angular position causes the eccentric cam to move the support about the pivot shaft, causing the intermediate member to rotate eccentrically with respect to the shaft axis. Reverse rotation of the control rod from the another angular position to the one angular position cause the intermediate member to rotate concentrically with respect to the shaft axis.

Similar VVA apparatuses are disclosed in U.S. Pat. No. 5,365,896 issued Nov. 22, 1994, U.S. Pat. No. 5,501,186 issued Mar. 26, 1996, and U.S. Pat. No. 5,687,681 issued Nov. 18, 1997.

JP-A 7-119425 teaches the use of control rod holding brackets in holding supports for movement within a plane perpendicular to the shaft axis of the driving shaft and a control rod. The control rod holding brackets are mounted to the cylinder head in addition to spaced cam brackets. The cam brackets are spaced one after another along the shaft axis and supports driven hollow camshafts. A sub-assembly is proposed which includes the control rod holding brackets, bearing caps, and the supports, and the control rod. The control rod holding brackets and the mating bearing caps are recessed inwardly away from each other to receive the control rod for rotation about a control rod axis. Each of the control rod holding brackets carries a pin for rotation about a pin axis. Each of the pins is received in a slot cut inwardly of one of the supports for allowing relative rotational and radial movement of the support to the bracket with respect to a centerline of the pin. The control rod has axially spaced eccentric cams, which are received in openings of the supports, respectively. After completion of assembly on an engine cylinder head, the control rod is drivingly connected to the supports. In operation, the control rod and the pins bear stress imparted to the supports due to valve springs of the engine cylinder valves. During eccentric operation mode, each of the intermediate members is subject to acceleration and deceleration under rotation of the driving shaft at a constant speed. To minimize cylinder-to-cylinder variability in valve lift characteristics, it is demanded to keep the amount of eccentricity of an axis of rotation of each of the intermediate members with respoect to the shaft axis of the driving shaft unaltered. However, the control rod is susceptible to flexure owing to the valve springs during the eccentric mode operation, causing the cylinder-to-cylinder variability in the eccentricity. Thus, the control rod holding brackets have to support the control rod at locations in the vicinity of portions where the control rod bears the stress of each of the supports. The known control rod holding brackets require mounting areas on the cylinder head in the vicinity of the adjacent supports.

An object of the present invention is to suppress the flexure of the control rod of the VVA apparatus of the above kind with a control rod holding structure that does not require mounting areas on the cylinder head in the vicinity of the adjacent supports.

SUMMARY OF THE INVENTION

According to the present invention, a VVA apparatus for moving cams controlling cylinder valves of an internal combustion engine relative to its driving shaft, comprises:

- spaced cam brackets fixed to a cylinder head of an internal combustion engine;
- driven hollow camshafts received in said cam brackets for rotation and including cams controlling cylinder valves of the engine;
- a driving shaft, having a shaft axis, extending through said camshafts for rotation about said shaft axis relative to said camshafts;
- driving sleeves around said driving shaft and fixed thereto for rotation therewith about said shaft axis;
- each of said driving sleeves and the adjacent one of said driven hollow camshaft including a driving flange and a driven flange that are spaced along said shaft axis and facing each other;
- supports, each being adapted for movement within a plane perpendicular to the shaft axis;
- intermediate members, each being supported in one of said supports for rotation about an axis thereof and drivingly connected between the adjacent driving and driven flanges;
- a control rod having predetermined spaced portions drivingly connected with said supports, respectively, for controlling position of each of said supports within said plane;
- a control rod holding structure including a base portion fixed to the cylinder head at portions in the vicinity of and around spark plug mounting holes,
- said control rod holding structure including bearing portions extending from said base portion, each of said bearing portions being arranged between the adjacent two cam brackets in the vicinity of the adjacent support,
- said bearing portions supporting said control rod at locations in the vicinity of said predetermined spaced portions so as to suppress flexure of said control rod around said predetermined spaced portions.

DESCRIPTION OF THE PREFERRED EMBODIMENTS

In the preferred embodiment described below, a VVA apparatus is employed, which is substantially the same as that disclosed by U.S. Pat. No. 5,365,896 (issued Nov. 22, 1994 to Hara et al.), which has been incorporated herein by reference in its entirety. The VVA apparatus employed in this embodiment uses a support for an intermediate member, which support is not disclosed nor taught by the U.S. Pat. No. 5,365,896.

In the embodiment, the intermediate member is in the form of a disc having a central opening for a driving shaft to extend with clearance. Thus, the intermediate member is named by the term "disc." The support for the intermediate is named by the term "disc housing."

Figure 1:
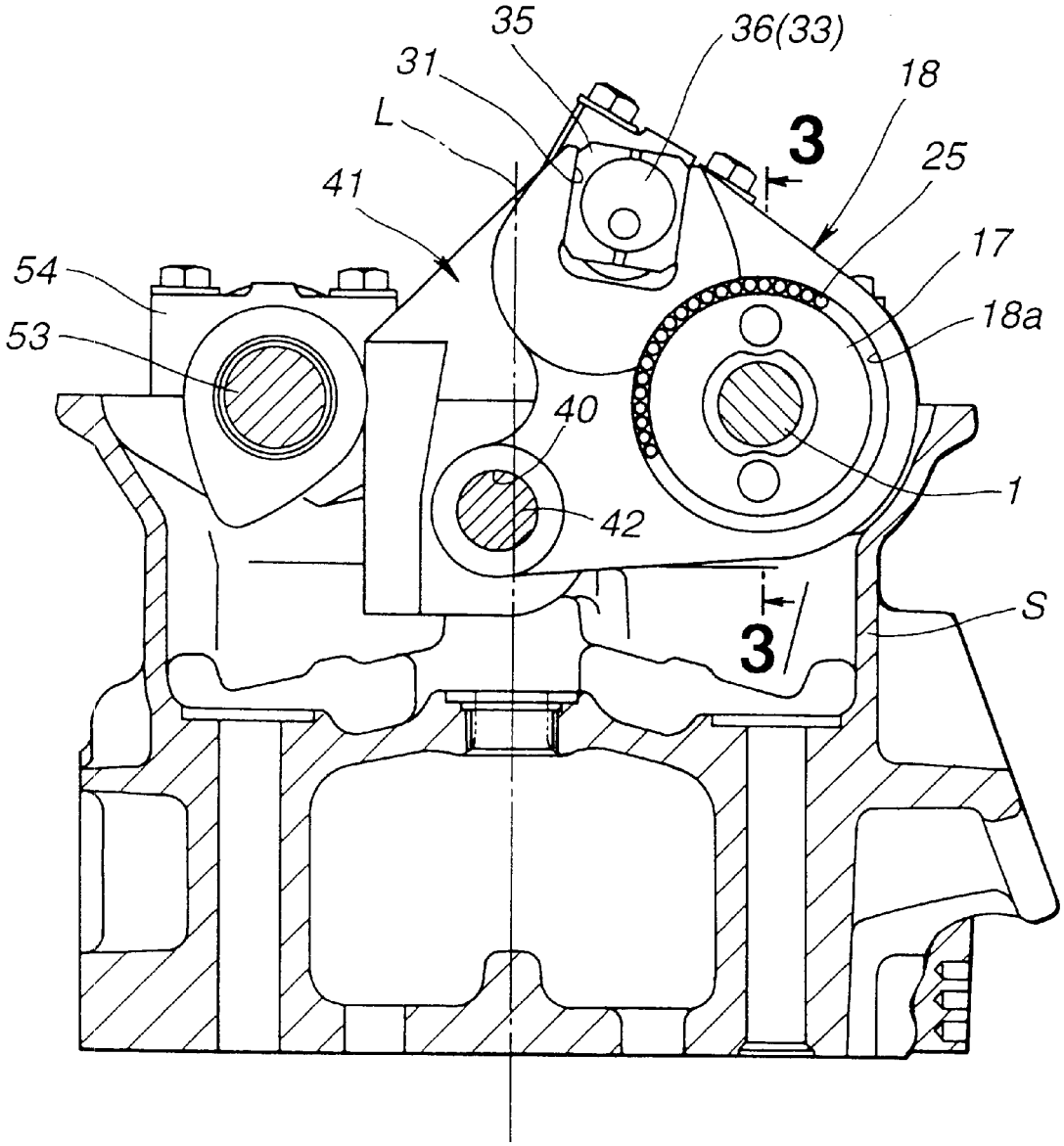
FIG. 1 is a transverse section of a cylinder head of an overhead camshaft engine, showing a control rod holding structure for suppressing flexure of a control rod of a VVA apparatus.
Figure 2:
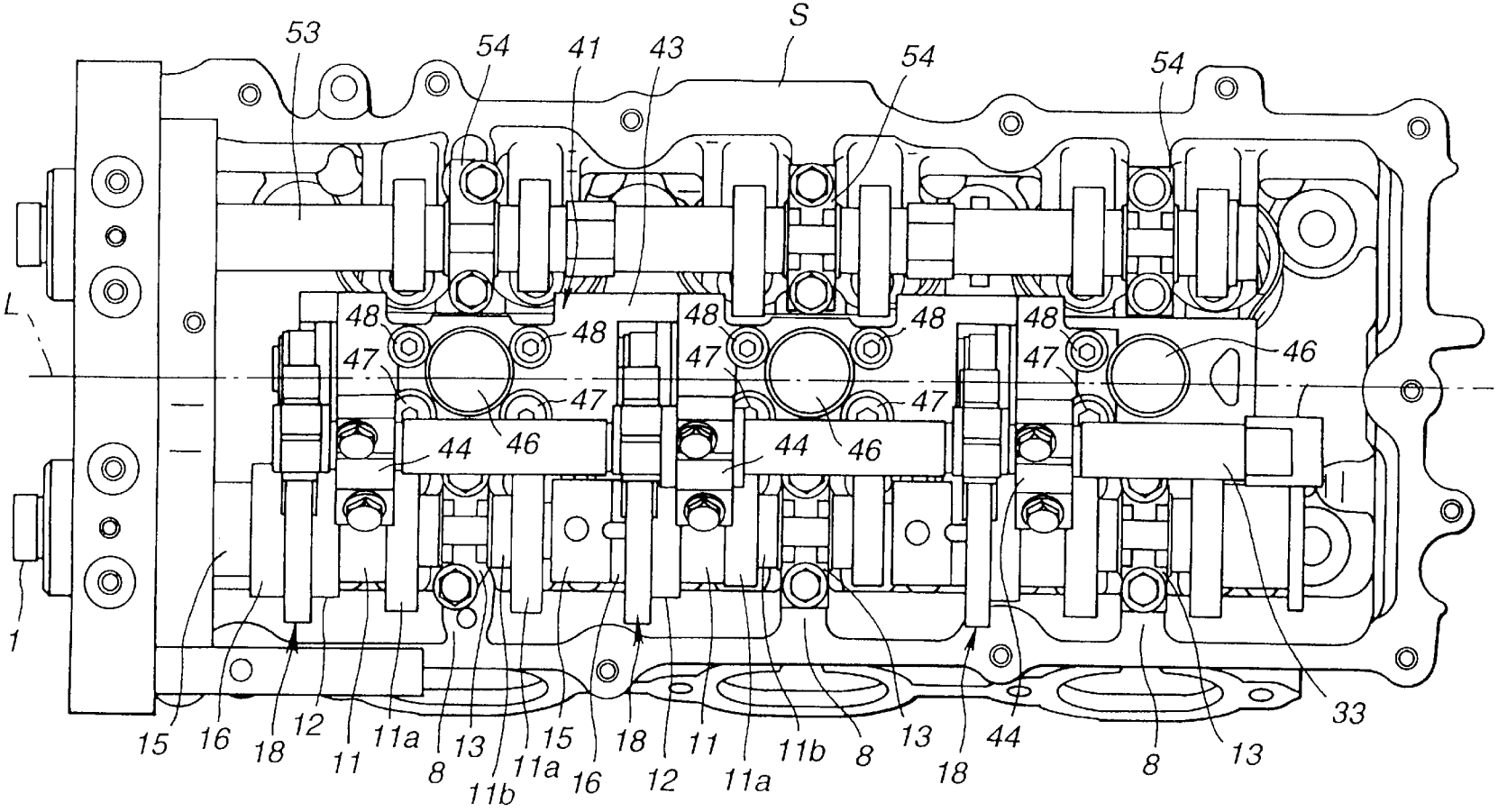
FIG. 2 is a plan view of the cylinder head with a camshaft cover removed.
Figure 3:
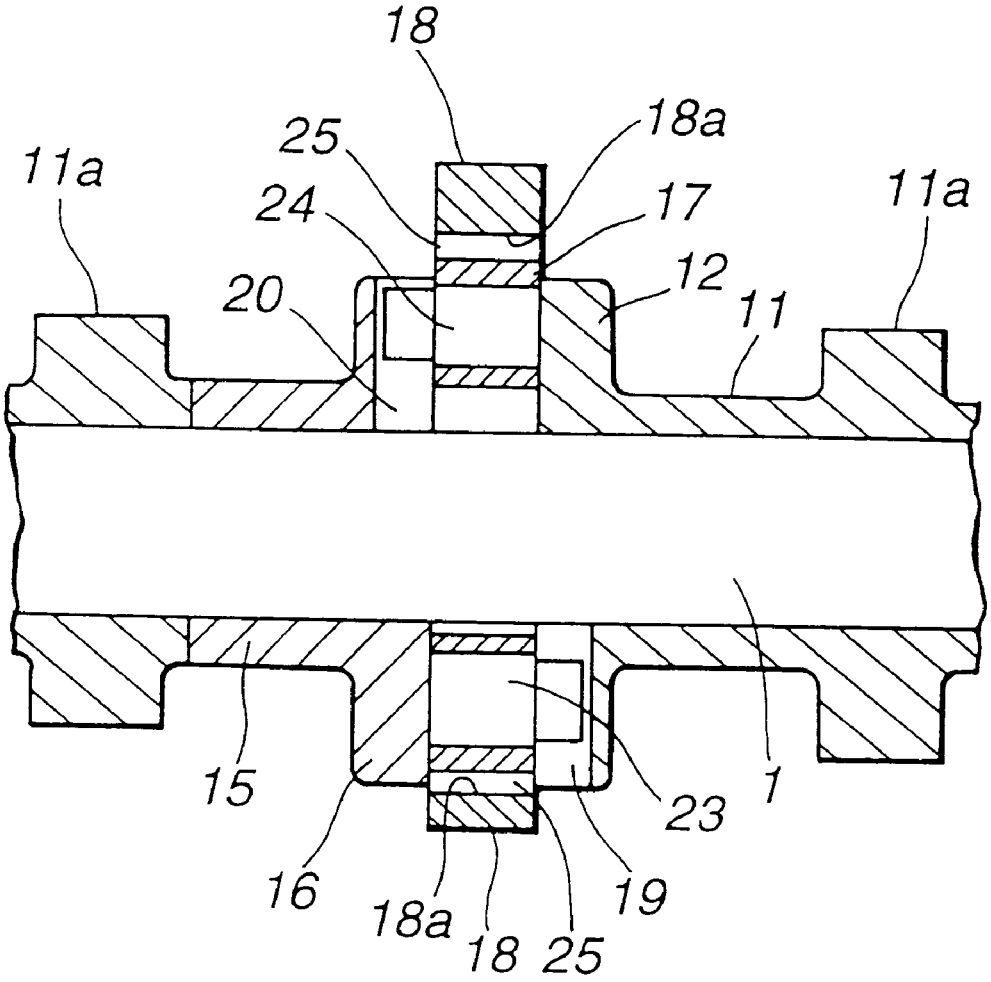
FIG. 3 is a sectional diagram of the VVA apparatus.

Referring to FIGS. 1 to 3, the reference numeral 1 designates a driving shaft mounted to one bank of a cylinder head S of an overhead camshaft V-6 internal combustion engine. The engine includes three cylinders per bank, including two intake valves and two exhaust valve, per cylinder, for admission of intake charge to the associated cylinder and for discharge of exhaust gas resulting from combustion of combustible charge in the cylinder. The driving shaft 1 extends continuously over all of cylinders of the one bank of the engine, which are arranged in line along a longitudinal line of the engine cylinder block. At one end thereof, the driving shaft 1 has a sprocket, not shown, for driving connection with a pulley fixed to a crankshaft of the engine via a timing chain.

The driving shaft 1 extends through independent driven member in the form of hollow camshafts 11. Each hollow camshaft 11 has two spaced cams 11*a* for actuation of cylinder valves, for example, intake valves, of the associated cylinder, and a journal portion 11*b* between the cams 11*a*. At the journal portions 11*b*, the hollow camshafts 11 are supported on semi-circular recesses of cam bracket mounting sites 8 (see FIG. 6 also) of the cylinder head S, respectively. Cam brackets 13 are fixed to the cam mounting sites 8, respectively, by bolts for supporting the hollow camshaft 11.

At one end thereof, each hollow camshaft 11 has an integral first flange 12. The flanges 12 are opposed to the mating second flanges 16 of driving members in the form of sleeves 15, respectively. The driving sleeves 15 allow the driving shaft 1 to extend through them and they are fixed to the shaft 1 for rotation therewith. Between each first flange 12 and its mating second flange 16 is disposed an intermediate member in the form of a disc 17 formed with a central opening through which the driving shaft 1 extends. The discs 17 are received in disc housings 18, respectively. Specifically, each disc housing 18 receives the associated disc 17 within an opening 18*a* thereof. A needle roller bearing 25 is disposed in the opening 18*a* to ensure rotation of the disc 17 within the housing 18.

As best seen in FIG. 3, the mating flanges 12 and 16 are formed with radial grooves 19 and 20, respectively, which grooves are displaced from each other in angular direction with respect to an axis of rotation of the driving shaft through 180 degrees. The disc 17 between the flanges 12 and 16 carries a first pin 23 and a second pin 24 for rotation relative thereto. The first pin 23 projects, in one direction, into the radial groove 19 of the first flange 12, and a second pin 24 projects, in the opposite direction, into the radial groove 20 of the second flange 16. The first and second pins 23 and 24 engage the radial grooves 19 and 20, respectively, for sliding motion in radial direction relative to the corresponding flanges 12 and 16. For smooth sliding motion, each of the pins 23 and 24 has flattened end portions defined by two parallel sides contacting with the groove walls. This pin and groove arrangement ensures that one rotation of the driving shaft 1 about the driving shaft axis causes one rotation of the disc 17 about a disc axis thereof, and the one rotation of the disc 17 about the disc axis causes one rotation of the camshaft 11.

If the disc axis is concentric with the driving shaft axis, there is no acceleration or deceleration of the camshaft 11 relative to the driving shaft 1 during one rotation of the driving shaft 1. This is because radial distance between the shaft axis and a point at which the radial groove 20 is engaged by the pin 24 and radial distance between the shaft axis and a point at which the radial groove 19 are engaged by the pin 23 are invariable.

Acceleration and deceleration of the camshaft 11 relative to the driving shaft 1 occur during one rotation of the driving shaft 1 if the disc axis is eccentric with the driving shaft axis. This is because the radial distances vary during one rotation of the driving shaft 1.

For further understanding of this mechanism, reference should be made to U.S. Pat. No. 5,365,896.

Referring to FIG. 1, each disc housing 18 is formed with a hole 40 receiving one of support shafts 42 of a control rod holding structure 41 for pivotal motion, about a central axis of the support shaft 42, within a transverse plane perpendicular to the driving shaft axis. Thus, the disc 17 is arranged to move within the transverse plane. Each disc housing 18 is formed with a groove 31 cut inwardly. The inwardly cut grooves 31 are aligned to receive a control rod 33. Specifically, each groove 31 has a rectangular profile and receives a rectangular slider 35 for sliding movement relative thereto. Each slider 35 has a central circular opening that receives one of circular eccentric cams 36 on the control rod 33 for rotary motion relative thereto. As best seen in FIG. 1, for ease of assembly, each slider 35 is divided into two halves. In assembly, the two halves of each slider 35 interpose therebetween one circular eccentric cam 36 and then this subassembly is inserted into the corresponding inwardly cut groove 31.

Figure 4:
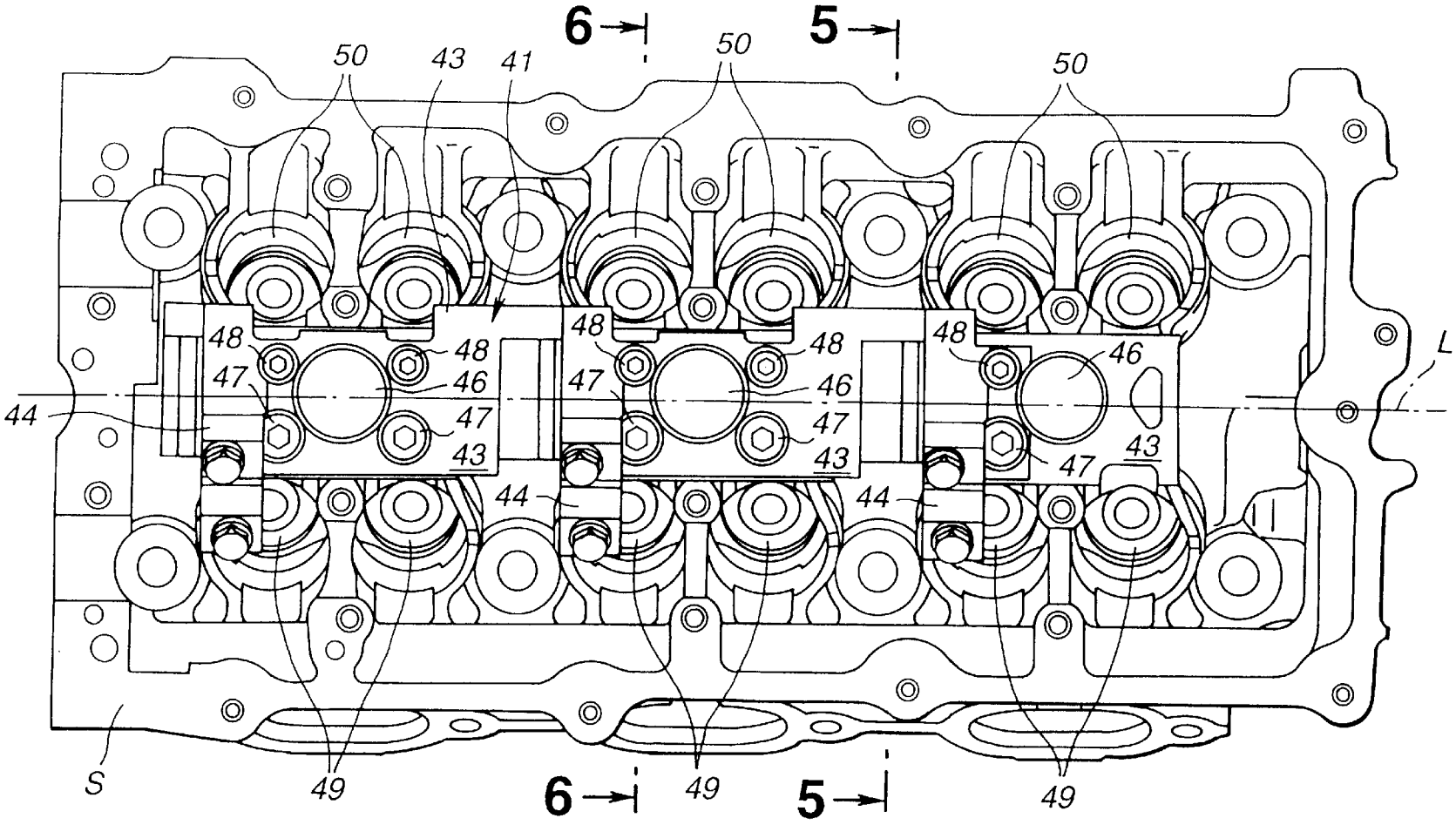
FIG. 4 is a plan view of the cylinder with unnecessary parts removed to show locations of first mounting bolts and second bolts.
Figure 5:
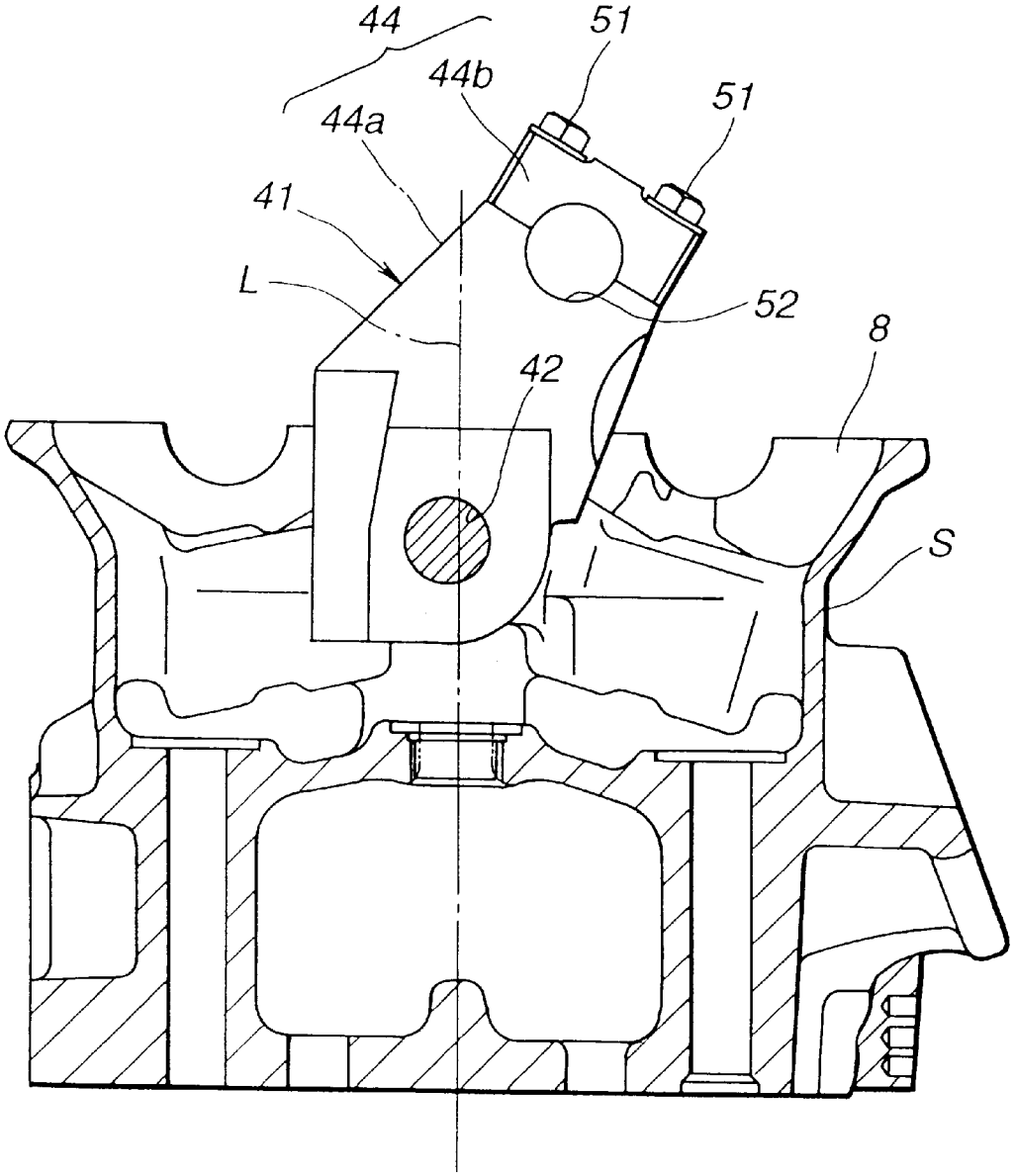
FIG. 5 is a cross section taken through the line 5—5 in FIG. 4.
Figure 6:
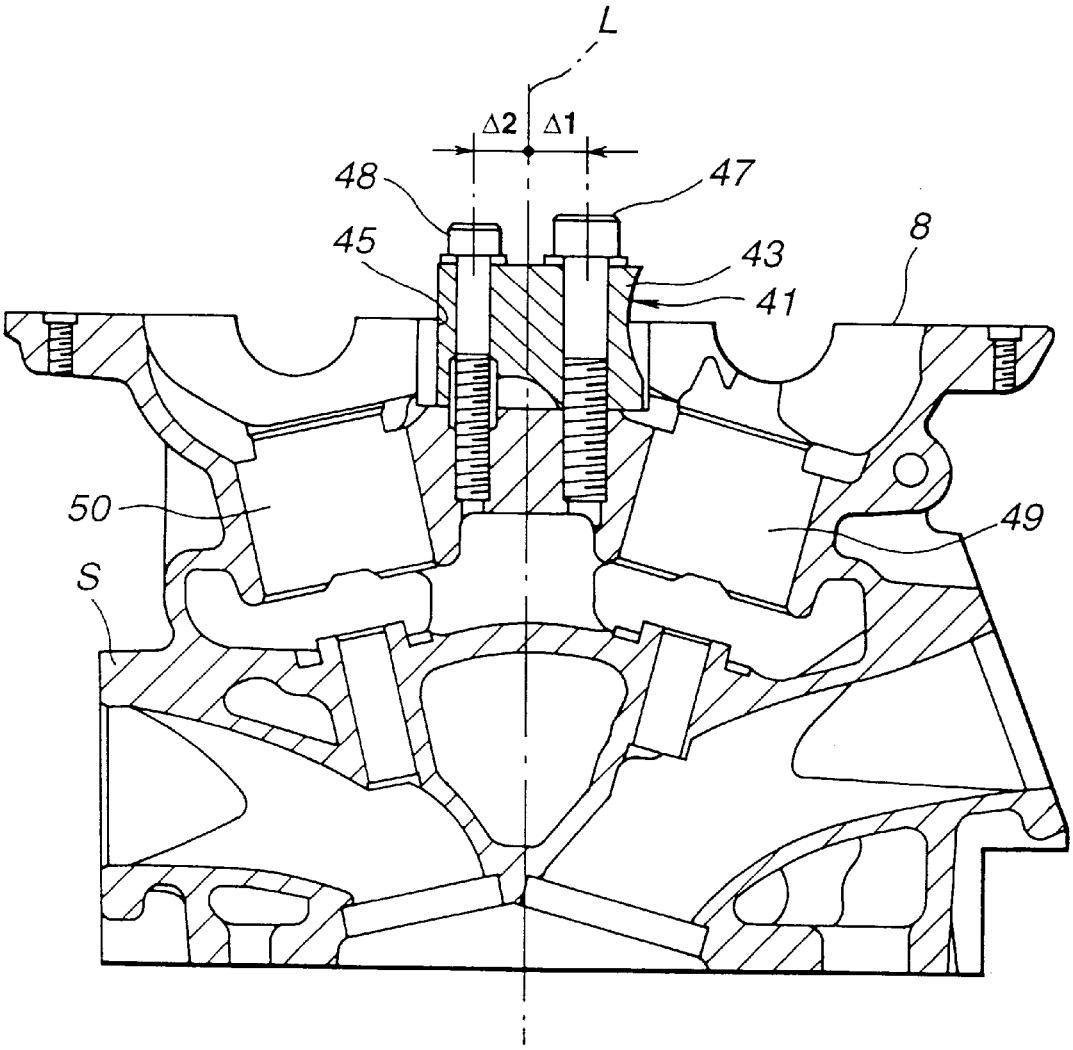
FIG. 6 is a cross section taken through the line 6—6 in FIG. 4.

Referring to FIGS. 4 to 6, the control rod holding structure 41, which has the support shafts 42 for the disc housings 18, includes a base portion 43 and integral bearing portions 44. As readily seen from FIGS. 4 and 6, the base portion 43 is received in mounting grooves 45 that are recessed inwardly from the top of the cylinder head S. The mounting grooves 45 are aligned in a longitudinal line of the cylinder head S. The longitudinal line is positioned within a center plane L in which axes of the cylinders of this bank are disposed. The cylinder head S has spark plug mounting holes, through which spark plugs communicate with the cylinders, respectively. The spark plug mounting holes are open within the bottom walls of the mounting grooves 45, respectively. The control rod holding structure 41 is formed with spark plug mounting circular windows 46 above the spark plug mounting holes, respectively. As shown in FIG. 4, the spark plug mounting windows 46 are aligned in the longitudinal line positioned within the center plane L. In the adjacent areas surrounding the spark plug mounting windows 46, the base portion 43 are fixedly attached to the cylinder head S by means of first bolts 47 and second bolts 48. With respect to the center plane L, the first bolts 47 are positioned on the intake side, while the second bolts 48 are position on the exhaust side.

As best seen in FIG. 4, the first bolts 47 are aligned along a first line extending in parallel and spaced relation with the center plane L. The second bolts 48 are aligned along a second line extending in parallel and spaced relation with the center plane L. As best seen in FIG. 6, the first line for the alignment of the first bolts 47 is spaced from the center plane L by a first distance Δ1 (delta one). The second line for the alignment of the second bolts 48 is spaced from the center plane L by a second distance Δ2 (delta two). The delta two Δ2 is less than the delta one Δ1. The second bolts 48 are smaller, in diameter, than the first bolts 47. Viewing in FIG. 4, except the spark plug mounting window 46 on the right, two first bolts 47 and two second bolts 48 are arranged around each spark plug mounting window 46. Around the spark plug mounting window 46 on the right, a single first bolt 47 and a single second bolt 48 are arranged.

The spark plug mounting windows 46 are positioned between intake valve lifter (IVL) bores 49 and exhaust valve lifter (EVL) bores 50. According to this arrangement, stress due to tightening the first and second bolts 47 and 48 around the windows 46 creates potential cause of deformation of the IVL and EVL bores 49 and 50. In operation of the engine, the EVL bores 50 are higher in temperature than are the IVL bores 49 due mainly to high temperature exhaust gas. Thus, with the same stress, the EVL bores 50 deform more appreciably than do the IVL bores 50. According to the embodiment, employing the second bolts 48 has reduced the stress applied to the EVL bores 50. The second bolts 48 have a sufficiently small diameter, offering a tightening force low enough to reduce stress applied to the EVL bores 50 to a sufficiently low level. If the first bolts 47 were of the same diameter as the diameter of the second bolts 48, the total force with which the control rod holding structure 41 was attached to the cylinder head S would not reach a satisfactory high level. Thus, the first bolts 47, which are used in the embodiment, are sufficiently enlarged, in diameter, to offer a complementary tightening force so that the total of the forces reaches the satisfactory high level. In order to further reduce the stress applied to the EVL bores 50, the second bolts 48 are remote from the EVL bores 50 further than the first bolts 47 are from the IVL bores 49. This relationship is represented by $\Delta 2<\Delta 1$.

As readily seen from FIGS. 4 and 5, the three bearing portions 44 are provided for three cylinders, respectively, and they extend from the base portion 43. Viewing in FIG. 5, the bearing portions 44 rise obliquely in a right upward and support the control rod 33 within an area near the disc housing 18. Each bearing portion 44 includes a main body portion 44*a* and a cap portion 44*b*. The cap portion 44*b* is securely fixed to the top surface of the main body portion 44*a* by means of bolts 51. The main body and cap portions 44*a* and 44*b* meet with each other at their mating surfaces. At their mating surfaces, they are recessed to form a bearing hole 52 that receives the control rod 33. The control rod holding structure 41 suppresses flexure of the control rod 33 due to the valve springs, thus improving stability of position of disc housings 18.

As viewed in FIG. 5, at lower portions, the control rod holding structure 41 is formed with the holes 40 that receive the support shafts 42. The support shafts 42 support the disc housings 18, respectively, for pivotal motions. The eccentric cams 36 are integrated with the control rod 33. Referring to FIG. 1, rotating the control rod 33 causes the eccentric cams 36 to alter their angular position, moving the disc housings 18 to pivot about the support shafts 42, respectively, relative to the control rod holding structure 41. This movement of the disc housings 18 causes the axis of the discs 17 to displace relative to the axis of the driving shaft 1, causing eccentricity of the discs 17 relative to the axis of the driving shaft 1 to vary.

The control rod 33 extends in parallel to the driving shaft 1. At one end, the control rod 33 is drivingly coupled with an actuator, not shown. At the opposite end, the control rod 33 is operatively connected with a position sensor, not shown.

Referring to FIGS. 1 and 2, the reference numeral 53 designates an exhaust camshaft that is supported by cam brackets 54 on the cylinder head S.

It is understood that the control rod 33 has predetermined spaced portions, where the eccentric cams 36 are, drivingly connected with the supports 18 in the form of the disc housings, respectively. The control rod holding structure 41, fixed to the cylinder head S, includes the bearing portions 44. Each bearing portion 44 is arranged between the adjacent two cam brackets 13 in the vicinity of the adjacent support 18. The bearing portions 44 support the control rod 33 at locations in the vicinity of the predetermined spaced portions so as to suppress flexure, due to the valve springs, around the predetermined spaced portions.

According to the preferred embodiment, the control rod holding structure 41 supports the control rod 33, while the cam brackets 13 support the hollow camshafts 11. Further, the bolts 47 and 48 fixedly attach the control rod holding structure 41 to the cylinder head S, and the bearing portions 44 of the control rod holding structure 41 support the control rod 33 within an area near the disc housings 18. Thus, the control rod holding structure 41 can suppress flexure of the control rod 33 due to the valve springs, securing smooth rotation of the control rod 33. Particularly, the control rod holding structure 41 suppresses variations of valve lift characteristics of individual cylinders.

According to the preferred embodiment, the control rod holding structure 41 is an integral piece that extends over the entire cylinders of each bank. The work of mounting the support structure 41 to the cylinder head S is simple and easy.

According to the preferred embodiment, the control rod holding structure 41 is different piece from the cam brackets 13 and supports the control rod 33. Thus, the bearing portions 44 for the control rod 33 have been simplified, in structure, making it easy to assemble the control rod 33.

According to the preferred embodiment, the second bolts 48 on the exhaust side are less in diameter than the first bolts 47 on the intake side, and the second bolts 48 are remote from the EVL bores 50 further than the first bolts 47 are from the IVL bores 49. This arrangement suppresses deformation of the EVL bores 50, ensuring smooth operation of the exhaust valve lifters, not shown.

According to the preferred embodiment, the cam brackets 13, the control rod holding structure 41 and the exhaust side cam brackets 54 are individually fixed to the cylinder head S by the bolts. Thus, the mating surfaces can maintain firm mutual engagement to seal clearances between them, preventing leak of lubricant oil through such clearances.

According to the preferred embodiment, the base portion 43 of the control rod holding structure 41 is a single piece that extends over the entire cylinders of each bank. If desired, the base portion may be divided into and consist of individual pieces for the cylinders, respectively. In this case, the individual pieces are fixed to the cylinder head S by the bolts 47 and 48.

The content of disclosure of japanese Patent Application No. 9-236624, filed Sep. 2, 1997 is hereby incorporated by reference in its entirety.

What is claimed is:

1. A variable valve actuator (VVA) apparatus for moving cams controlling cylinder valves of an internal combustion engine relative to its driving shaft, comprising:

spaced cam brackets fixed to a cylinder head of an internal combustion engine;

driven hollow camshafts received in said cam brackets for rotation and including cams controlling cylinder valves of the engine;

a driving shaft, having a shaft axis, extending through said camshafts for rotation about said shaft axis relative to said camshafts;

driving sleeves around said driving shaft and fixed thereto for rotation therewith about said shaft axis;

each of said driving sleeves and the adjacent one of said driven hollow camshaft including a driving flange and a driven flange that are spaced along said shaft axis and facing each other;

supports, each being adapted for movement within a plane perpendicular to the shaft axis;

intermediate members, each being supported in one of said supports for rotation about an axis thereof and drivingly connected between the adjacent driving and driven flanges;

a control rod having predetermined spaced portions drivingly connected with said supports, respectively, for controlling position of each of said supports within said plane;

a control rod holding structure including a base portion fixed to the cylinder head at portions in the vicinity of and around spark plug mounting holes, said control rod holding structure including bearing portions extending from said base portion, each of said bearing portions being arranged between the adjacent two cam brackets in the vicinity of the adjacent support, said bearing portions supporting said control rod at locations in the vicinity of said predetermined spaced portions so as to suppress flexure of said control rod around said predetermined spaced portions.

2. The VVA apparatus as claimed in claim 1, wherein said control rod has eccentric cams at said predetermined spaced portions, respectively, wherein said supports are formed with grooves cut inwardly receiving sliders, respectively, and wherein said sliders having openings receiving said eccentric cams, respectively.

3. The VVA apparatus as claimed in claim 1, wherein each of said intermediate members includes a disc having a central opening through which said driving shaft extends, and wherein each of said supports is in the form of a disc housing supporting the adjacent disc for rotation.

4. The VVA apparatus as claimed in claim 3, wherein each of said disc carries a first pin and a second pin, and the adjacent driving and driven flanges are formed with first and second radial grooves, respectively, receiving said first and second pins, respectively.

5. The VVA apparatus as claimed in claim 2, wherein said control rod holding structure carries support shafts holding said supports for movement with planes perpendicular to the shaft axis.

6. The VVA apparatus as claimed in claim 1, wherein said base portion of said control rod holding structure extends continuously over cylinders of the engine below the cylinder head.

7. The VVA apparatus as claimed in claim 1, wherein the control rod holding structure is formed with spark plug mounting windows above the spark plug mounting holes, respectively, and said spark plug mounting windows are aligned in a longitudinal line positioned within a center plane of the cylinder head.

8. The VVA apparatus as claimed in claim 7, wherein the cylinder head is formed with intake valve lifter (IVL) bores and exhaust valve lifter (EVL) bores, and wherein said spark plug mounting windows are positioned between said IVL bores and said EVL bores.

9. The VVA apparatus as claimed in claim 8, further comprising;

first bolts fixedly attaching said base portion to the cylinder head and positioned between said center plane and said IVL bores;

second bolts fixedly attaching said base portion to the cylinder head and positioned between said center plane and said EVL bores;

said first bolts being spaced from said center plane by a first distance, said second bolts being spaced from said center plane by a second distance, said second distance being less than said first distance.

10. The VVA apparatus as claimed in claim 9, wherein said second bolts are smaller in diameter than said first bolts are.

* * * * *